United States Patent [19]

Renaud

[11] 3,954,348

[45] May 4, 1976

[54] DEVICES FOR RENDERING PUMPS TIGHT

[75] Inventor: Georges Renaud, Nogent-sur-Marne, France

[73] Assignee: Pompes Multiflux, Société Anonyme, Paris, France

[22] Filed: Nov. 30, 1973

[21] Appl. No.: 420,599

[30] Foreign Application Priority Data

Dec. 8, 1972 France ..... 72.43719

[52] U.S. Cl. ..... 415/113; 415/175

[51] Int. Cl.[2] ..... F04D 29/10

[58] Field of Search ..... 415/111, 112, 113, 175

[56] References Cited

UNITED STATES PATENTS

| | | | |
|---|---|---|---|
| 879,484 | 2/1908 | Morterud | 415/111 |
| 1,721,737 | 7/1929 | Joyce | 415/111 |
| 1,835,877 | 12/1931 | Joyce | 415/111 |
| 2,002,907 | 5/1935 | Sessions | 415/113 |
| 2,244,450 | 6/1941 | Erni | 415/113 |
| 2,423,825 | 7/1947 | Blom | 415/175 |
| 2,427,656 | 9/1947 | Blom | 415/176 |

FOREIGN PATENTS OR APPLICATIONS

| | | | |
|---|---|---|---|
| 228,945 | 5/1925 | United Kingdom | 415/113 |

*Primary Examiner*—C. J. Husar

*Attorney, Agent, or Firm*—Stevens, Davis, Miller & Mosher

[57] ABSTRACT

This invention relates to a device for rendering pumps tight of the type in which the pressure of the auxiliary liquid is a function of the pressure prevailing in the pump body, wherein the stuffing box communicates with a reservoir constituted by a casing open on one face but normally closed by an elastically deformable membrane covered by a casing communicating with the pump body.

2 Claims, 2 Drawing Figures

DEVICES FOR RENDERING PUMPS TIGHT

The present invention relates to improvements in devices for rendering pumps tight.

It is known that the tightness between the body of the pump and the turbine is ensured by the interposition of mechanical packings, fixed and rotary ones respectively, applied against one another and lubricated by an auxiliary barrage liquid contained in a casing and pressurised by the interposition of an ancillary device.

French Patent Application No. 7,216,054 filed on May 5, 1972 by the Applicant describes a device enabling the pressure of auxiliary fluid to be automatically varied as a function of that of the liquid passing through the pump.

To this end, the auxiliary liquid was contained in a tank, communicating with the stuffing box, containing an elastically deformable bellows communicating with the pump body.

This device which operated satisfactorily was, however, costly. In fact, the reservoir had to be made of two parts which had to be assembled in tight manner.

Moreover, the elastically deformable capsule dipped in the auxiliary liquid had to be tightly connected to the body of the pump by the interposition of a pipe passing through the body of the reservoir.

The present invention, which remedies these drawbacks, relates to an advantageous embodiment of the reservoir which enables the liquid contained in the pump body and the auxiliary liquid to be separated.

The invention will be more readily understood on reading the following description with reference to the accompanying drawings, in which.

Figure 1:
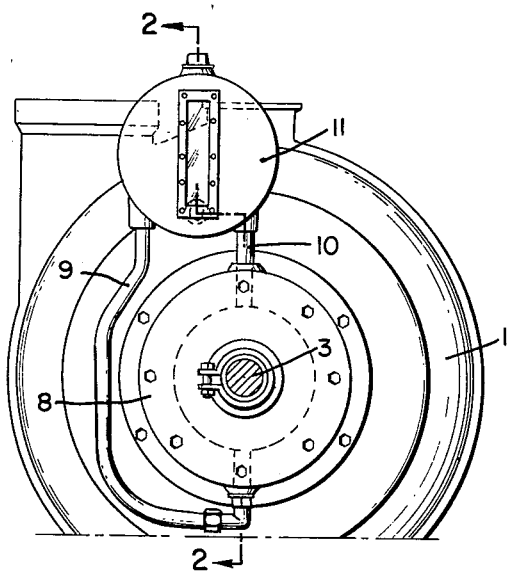
FIG. 1 is an elevational view showing the reservoir of the invention mounted on a pump.
Figure 2:
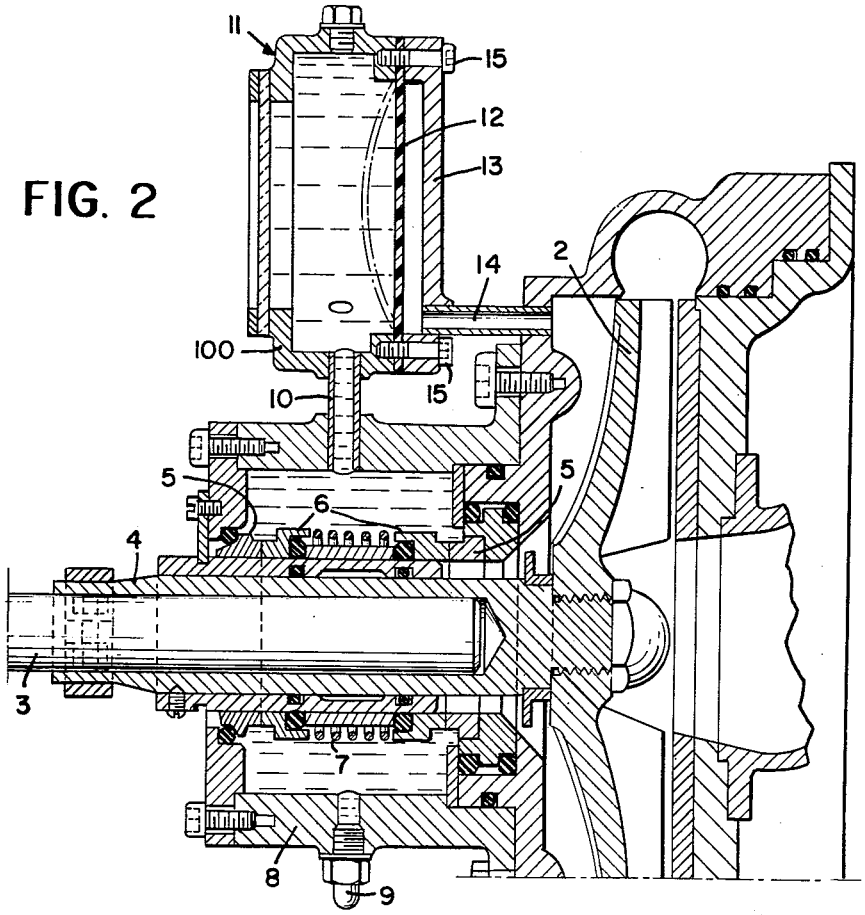
FIG. 2 is a section, on a larger scale, through the reservoir of the invention, along broken line a-b-c-d of FIG. 1.

Referring now to the drawings, 1 represents the pump body 1 containing a turbine 2, for example with central suction, connected to the end of a shaft 3 by the interposition of a conventional sleeve 4.

The tightness between the body 1 and sleeve 4 is ensured by two pairs of packings 5–6 which are fixed and movable respectively.

The packings 6, keyed in rotation only on the rotary assembly, are axially applied, by the interposition of a spring 7, against the packings 5 made fast with a casing 8 fixed to the body 1 and containing an auxiliary liquid under pressure.

According to the present invention, the casing 8 is connected by the interposition of two pipes 9 and 10 to a tank 11.

The tank 11, constituted by a casing 100 open on one face is closed by a supple elastically deformable wall or membrane 12 covered by a casing 13 communicating, by the interposition of a pipe 14, with the interior of the body 1 on the high pressure side. The nature and form of the membrane 12, which may be honeycombed, are appropriated to the pressure and nature of the fluid passing through the pump body. In the Example shown, the membrane 12 is flat and slightly stretched.

Screws 15 make it possible to maintain the two casings 11 and 13 assembled, the membrane 12 whose edges are gripped together, ensuring the tightness of the assembly.

In this way, it is seen that the membrane 12 fulfills three functions:

it separates the liquid passing through the pump and the auxiliary liquid;

it transmits all the variations in pressure;

it ensures the tightness of the reservoir 11.

What I claim is:

1. In a pump having a rotor mounted on a rotor shaft for rotation therewith, a device for insuring the tightness of the pump comprising a first housing, a first chamber within the first housing containing an auxiliary fluid and surrounding the rotor shaft, packings disposed between the said first housing and the rotor shaft to form a fluid tight seal therebetween, a second housing enclosing a second and third chamber, said second housing being formed by two separate casings having edges secured together, a supple elastically deformable membrane having its edges gripped between said edges of the housing and separating the said second and third chambers, said edges of the membrane sealing the joint between the edges of the casings, means for connecting the first and second chambers for fluid flow therebetween, and means for connecting the third chamber and the high pressure side of the pump.

2. In a pump having a first housing, a first chamber in the first housing, a turbine disposed in the first housing, a shaft for rotation of the turbine, a sleeve disposed about the shaft for rotation therewith and connected to the turbine, a second housing disposed about the sleeve and joined at one end to the first housing, means for sealing the joint between the first and second housings, an annular chamber in the second housing about the sleeve, a third housing enclosing a space for liquid, said third housing being formed by joining edges of two casings together, a flexible membrane having its edges clamped between edges of the two casings and dividing the said space into third and fourth chambers, means for flow of liquid between the second and third chambers, and means connecting the first and fourth chambers for fluid flow, whereby changes in pressure within the first chamber are transmitted to the fourth chamber and the membrane flexes in response thereto and transmits variations in pressure in the first chamber to liquid in the third and second chambers.

* * * * *